US006298505B1

(12) United States Patent
Brivio

(10) Patent No.: US 6,298,505 B1
(45) Date of Patent: Oct. 9, 2001

(54) CUSHIONED SUPPORT SYSTEM FOR AN ORTHOPAEDIC BEDSPRING

(76) Inventor: Onorato Brivio, Via del Ronco, 40 Carimate (IT)

( * ) Notice: Subject to any disclaimer, the term of this patent is extended or adjusted under 35 U.S.C. 154(b) by 0 days.

(21) Appl. No.: 09/596,723

(22) Filed: Jun. 19, 2000

(30) Foreign Application Priority Data

Jun. 25, 1999 (EP) ..... 99830404

(51) Int. Cl.[7] ..... A47C 23/06
(52) U.S. Cl. ..... 5/236.1
(58) Field of Search ..... 5/236.1, 238, 237

(56) References Cited

U.S. PATENT DOCUMENTS 3,810,265 5/1974 McGrew .
5,038,429 8/1991 Elmalek et al. ..... 5/236.1

FOREIGN PATENT DOCUMENTS

0038155 * 10/1981 (EP) ..... 5/238
0697184 2/1996 (EP) .

* cited by examiner

*Primary Examiner*—Alexander Grosz
(74) *Attorney, Agent, or Firm*—Bucknam and Archer

(57) ABSTRACT

Cushioned support system for an orthopaedic bedspring (1) comprising a plurality of slats (2) made of material which is rigid or has a controlled flexibility and designed to be fixed to an orthopaedic bed, characterized in that it comprises in combination:

a box-shaped body (5) which has a substantially U-shaped cross-section open at the top and extending along the whole length of said bedspring (1) to the inner side of which it is intended to be longitudinally fixed;

a tubular reservoir (6) which is sealed at its opposite ends and at least partially filled with a fluid of predefined density and at a predefined pressure, said tubular reservoir (6) being positioned inside said box-shaped body (5) and extending substantially along the whole length of said body;

a profiled member (7) made of elastically deformable plastic material and movably guided inside said box-shaped body (5) towards and away from the bottom wall **(5*a*) thereof, said profiled member (7) resting on said tubular reservoir (6)** and extending substantially along the whole length thereof.

13 Claims, 1 Drawing Sheet

CUSHIONED SUPPORT SYSTEM FOR AN ORTHOPAEDIC BEDSPRING

More generally the present invention relates to an orthopaedic bed and the like, of the type comprising a frame essentially consisting of a headboard and a footboard which are joined together and made rigid by a pair of longitudinal members, an orthopaedic bedspring comprising a plurality of bars which are rigid or have a predefined elasticity—commonly called slats—and which extend transversely with respect to said longitudinal members and have opposite ends resting on a cushioned support system associated with the longitudinal members themselves, so as to allow said bars to assume an arrangement according to the profile of the person resting on the orthopaedic bedspring and profile.

More particularly, the invention relates to a cushioned support system of the abovementioned type.

With regard to the construction of orthopaedic beds with a bedspring consisting of slats, for some time various cushioned support systems for the plurality of slats which form said bedspring have been proposed, all of said systems being essentially based on the use of tubular reservoirs which are sealed at their opposite ends and filled or partially filled with a fluid of suitable density, for example and preferably, water or aqueous solutions containing thickening substances with a viscosity which can be adjusted. Said tubular reservoirs, which are generally made with flexible materials, extend along the whole length of the longitudinal members of the orthopaedic bed and are positioned inside respective box-shaped seats which also extend along the whole length of said longitudinal members to which they are fixed using conventional means. Said box-shaped seats are open at the top so that the tubular reservoirs 2 are accessible at the respective opposite ends of each of the slats which form the orthopaedic bedspring and which must be fixed thereon. Under the weight of a person lying on said bedspring, the tubular reservoirs are subject to a greater compression in the region of those slats which are under the most pressure and to a much smaller compression or no compression or even a "swelling" effect in the region of the slats which are under no pressure.

Consequently this results in the arrangement of the slats at different heights compared to the initial flat arrangement, with the orthopaedic bedspring adapting to the shape and profile of the user's body and with a substantially equal pressure over all the slats.

Although advantageous in certain respects, the cushioned support systems for the slats of an orthopaedic bedspring, proposed by the known art, suffer from various drawbacks—hitherto unresolved—the main one of which consists in the usually too rapid "response" to the stresses produced by a body which is resting on the bedspring or to relatively sudden movements of a body resting on said bedspring, which "response" may result in too sudden displacements of the slats and, therefore, sensations of considerable discomfort for the user. Moreover, these sensations may be prolonged over time on account of the so-called "oscillation" phenomenon basically due to the displacements, in either direction and by a decreasing amount, of the liquid inside the respective tubular reservoirs. In order to reduce the effects of the abovementioned phenomenon, certain measures have been adopted such as that of adding water containing substances which are designed to increase the viscosity thereof or that of designing the individual tubular reservoirs in the form of a plurality of successive segments communicating with each other via very narrow channels or constrictions able to slow down the movements of the liquid inside them. But even when adopted in combination, measures of the abovementioned type have been unable to eliminate the drawbacks, while they have generally resulted in greater structural and functional complexity of the cushioned support system, making it unreliable during use and uneconomical from the production point of view.

Another drawback of a more specifically structural nature arises from the method generally used in cushioned support systems of the known art in order to guide the slats during their vertical displacements in accordance with the deformations of the tubular reservoirs. In fact, according to the teachings of the known art, for this purpose an end section of each slat is (of smaller width) is slidably engaged in vertical guide slots formed in the walls of the box-shaped seat which receives the tubular reservoir. In this way, when the slats are subject to considerable stress (as occurs, for example, in the case of the slats underneath the heaviest parts of the user's body or following a concentration of weight in a small space when the user sits on the orthopaedic bed), resulting in a corresponding significant compression of the tubular reservoir, the ends of the slats sink inside the box-shaped structure, so that the top edges of the latter suddenly come into contact with the mattress and are felt by the user, resulting in discomfort.

The problem underlying the present invention is that of providing a cushioned support system for the slats of an orthopaedic bedspring, which has structural and functional characteristics such as to overcome definitively the drawbacks mentioned with reference to the known art.

This problem is solved according to the present invention by a cushioned support system for the slats of an orthopaedic bedspring which has the structural characteristics indicated in claim 1 below.

The invention also relates to an orthopaedic bedspring associated with a cushioned support system of the abovementioned type, as well as an orthopaedic bed which has a bedspring consisting of slats supported by a cushioned support system according to the invention.

The characteristic features and advantages of a cushioned support system according to the invention will emerge more clearly from the description which follows of an example of embodiment thereof, with reference to the accompanying drawings provided by way of a non-limiting example, in which.

Figure 1:
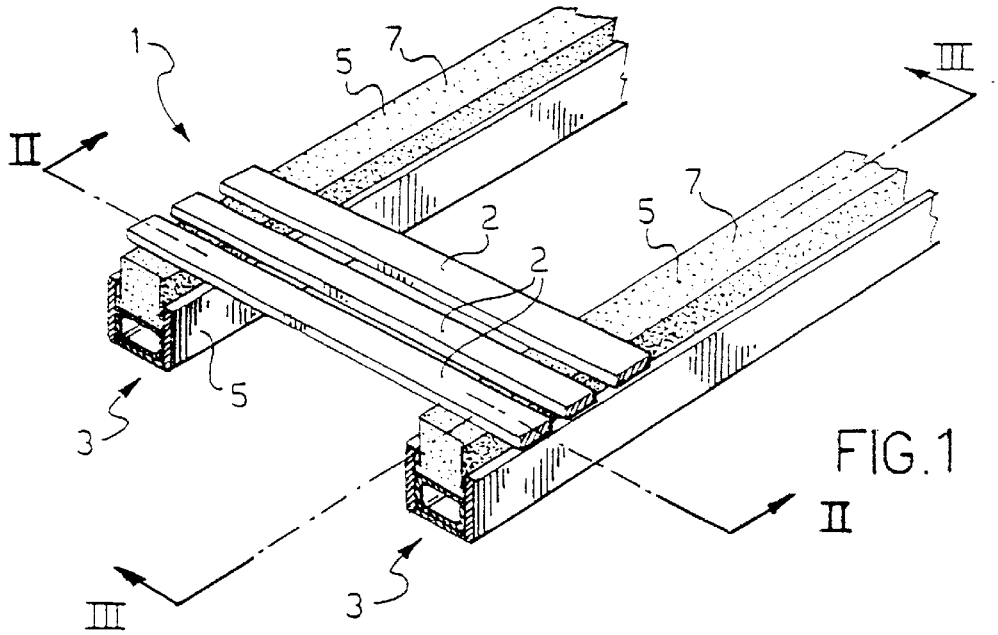
FIG. 1 shows in schematic form an axonometric and partially sectioned view of an orthopaedic slat-type bedspring associated with a slat support system according to the invention.

With reference to the abovementioned Figures, an orthopaedic bedspring according to the invention, which is denoted in its entirety by 1, comprises a plurality of slats 2 made of rigid material or material with a limited or controlled flexibility, preferably wood, the opposite ends of each of which rest on and are fixed to a pair of identical cushioned support systems which are denoted in their entirety by 3. Since they are identical, in the following description reference will be made to only one of said systems 3; the structural details of the other system, which are identical to those of the system described, will be indicated by the same reference numbers.

According to the present invention, a cushioned support system 3 comprises a box-shaped body 5 having a U-shaped cross-section and extending along the whole length of the bedspring 1 to which it must be fixed. Said box-shaped body 5 is open at the top and receives and supports inside it a tubular reservoir 6 which is made of flexible material and sealed at its opposite ends and partially filled with an aqueous solution containing a thickening substance in a concentration which is predefined according to a preferred viscosity of said solution.

Preferably the material from which the abovementioned tubular reservoir is made consists of a combination of polythene/polyester, or nylon, the polythene sheet forming the inner side of said reservoir 6. It has been shown that such a material has excellent properties of mechanical strength and flexibility and tightness which said reservoir must ensure in accordance with the present invention.

Advantageously the thickening substance included in the aqueous solution consists of a derivative of cellulose commercially known by the name CARBOMER, in quantities of between 0.1% and 1%.

A profiled member 7, which is made of elastically deformable plastic material, preferably expanded polyurethane with an apparent density of between 100 to 200 kg/m$^3$, is slidably guided in the box-shaped body 5.

Figure 2:
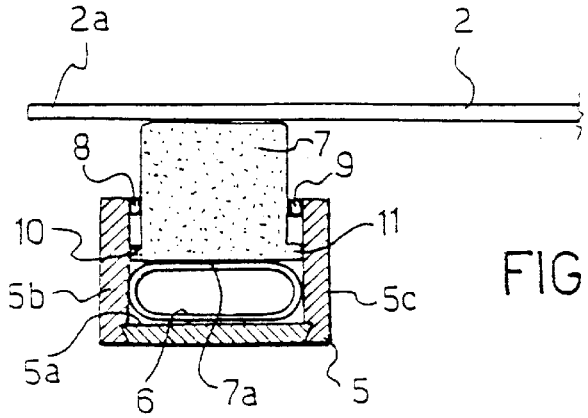
FIG. 2 shows a cross-section, on a larger scale, along the line II—II of FIG. 1.

Said profiled member 7, which rests on the tubular reservoir 6, extends substantially along the whole length of said reservoir 6 and has a cross-section which is substantially identical to that of the box-shaped body 5. Preferably, with reference to FIG. 2, said profiled member 7 has a height which is slightly greater than the depth of said box-shaped body 5.

In order to guide the profiled member 7 during its movements inside the box-shaped body 5 towards and away from the bottom 5*a* thereof and, in order to prevent said profiled member 7 from coming out of said box-shaped body during use of the orthopaedic bedspring 1, the vertical facing walls 5*b* and 5*c* of said body 5 are provided at the top, on the inner side, with edges 8 and 9 which are identical and extend by the same amount along the whole length of the box-shaped body itself. Identical edges 10 and 11 are longitudinally provided on the profiled member 7 along its bottom wall 7*a* resting on the reservoir 6.

Figure 3:
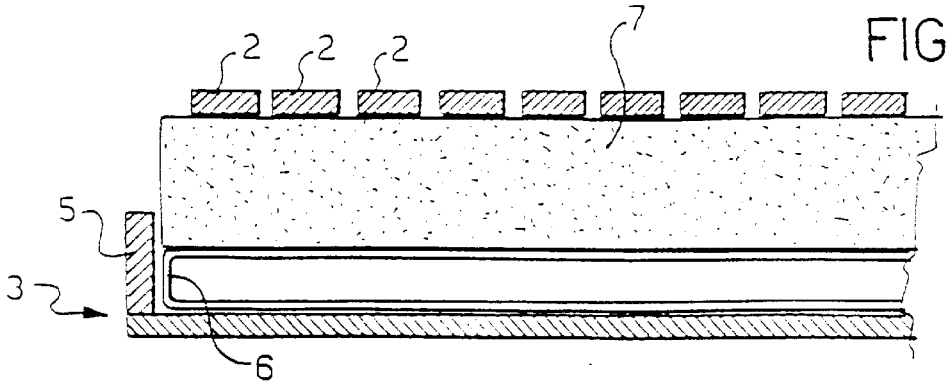
FIG. 3 shows a cross-section, on a larger scale, along the line III—III of FIG. 1.

With reference to FIG. 3, the opposite ends of the slats 2 of the orthopaedic bedspring 1 are fixed, using conventional means not shown, onto the pair of polyurethane profiled members 7. Advantageously said slats (FIG. 2) project outside the profiled members 7, with respective sections 2*a* extending so as to "cover" at least the box-shaped body 5.

During use of an orthopaedic bedspring supported by the cushioned support system described further above, it was possible to ascertain that the polyurethane profiled member 7 and the reservoir 6, on which it rests, operate in synergy, providing a "damping" effect for the weight of the user which is decidedly greater than the effects individually provided by the said profiled member and said reservoir.

In fact, the profiled member 7, which, as already mentioned, extends continuously along the whole length of the box-shaped body 5, is not a simple element for transmitting the stresses from the bedspring 1 to the tubular reservoir 6; even before being displaced towards the inside of the box-shaped body and therefore pressing against the tubular reservoir 6, it initially absorbs said stresses by means of deformation; only subsequently, with a certain delay due to the chemical and physical properties with which it is provided, does it start to press against said reservoir 6.

Consequently, the "response" of the tubular reservoir 6 to the various stresses which originate from the orthopaedic bedspring 1 is also delayed, thereby overcoming the main drawback attributed to the known art.

Moreover, the thrusts which the reservoir 6 directs towards the orthopaedic bedspring as a "reaction" to the abovementioned stresses are initially partially absorbed by the profiled member 7 which, only after a delay, is raised away from the bottom of the respective body 5 which contains it. Thus the other drawbacks of the support systems of the known art, namely the sudden raising of one or more slats and the oscillation effect due to the movements of the liquid solution inside the tubular reservoirs, are also overcome.

A further advantage achieved by the cushioned support system according to the present invention consists in the fact that, owing to the presence of the expanded polyurethane profiled member 7 and the dimensions with which it is designed, the orthopaedic bedspring 1 never comes into direct contact with the solid structure of the box-shaped body 5, not even when a considerable stress localised in a small amount of space (for example when the user sits on the edge of the orthopaedic bed) may cause total compression of the tubular reservoir 6. Therefore, contrary to what happens with the systems of the known art, the surprising degree of comfort which is generally offered by the cushioned support system according to the present invention is guaranteed at all times.

Yet another not insignificant advantage consists in the fact that, with an orthopaedic bedspring supported by a cushioned system as described above, it is possible to use mattresses which have a thickness which is reduced by up to 50% and more compared to that of conventional mattresses, without thereby diminishing in any way the standard of comfort achieved. In fact, all the functions and the characteristics which are normally associated with a good mattress are achieved even more successfully by the abovementioned orthopaedic bedspring, in particular owing to the presence of the profiled member 7 which performs most of the functions hitherto assigned to the mattress.

What is claimed is:

1. A cushioned support system for an orthopaedic bedspring (1), said orthopaedic bedspring (1) including two spaced apart longitudinally extending cushioned support systems (3) having a plurality of transversely extending slats (2) extending therebetween, said cushioned support system (3) comprising:

a box-shaped body (5) having a substantially U-shaped cross-section open at the top and extending the length of said bedspring (1);

a tubular reservoir (6) sealed at its opposite ends and at least partially filled with a fluid of predefined density and at a predefined pressure, said tubular reservoir (6) being disposed inside said box-shaped body (5) and extending substantially along the length thereof;

a profiled member (7) made of elastically deformable plastic material and being telescopically movably guided inside said box-shaped body (5) towards and away from a bottom wall (5*a*) thereof, said profiled member (7) resting on said tubular reservoir (6) substantially along the length thereof and protruding from the open top of said box-shaped body (5) whereby said slats (2) can be supported on said protruding profiled member (7).

2. The cushioned support system according to claim 1, wherein said profiled member (7) has a cross-section which substantially conforms to the shape of said box-shaped body (5).

3. The cushioned support system according to claim 1, wherein said box-shaped body (5) is provided with means (8, 9) for guiding said profiled member.

4. The cushioned support system according to claim 1, wherein means (8 to 11) are provided for preventing the dislodgment of said profiled member (7) from said box-shaped body (5).

5. The cushioned support system according to claim 4, wherein said preventing means consist of rectilinear edges (8, 9) longitudinally formed at the open top end of said box-shaped body (5), on facing sides thereof, and of corresponding rectilinear edges (10, 11) longitudinally formed at a bottom wall (7*a*) of said profiled member (7) resting on said tubular reservoir (6).

6. The cushioned support system according to claim 1, wherein said profiled member (7) is made of expanded polyurethane of predefined density.

7. The cushioned support system according to claim 1, wherein said tubular reservoir (6) is formed of a combination of polythene and polyester, the polythene forming the internal wall of said reservoir (6).

8. The cushioned support system according to claim 1, wherein said tubular reservoir (6) is formed of a combination of polythene and nylon, the polythene forming the inner wall of said reservoir (6).

9. The cushioned support system according to claim 1, wherein said fluid consists of water to which a thickening substance for adjusting the viscosity is added.

10. The cushioned support system according to claim 9, wherein said substance is a cellulose compound.

11. The cushioned support system according to claim 10, wherein said substance is comprised in said solution in a quantity of between 0.1–1.0% by weight.

12. An orthopaedic bedspring (1) comprising a plurality of rigid slats wherein the opposite ends of each of said slats (2) are fixed onto respective profiled members (7) of two facing cushioned support systems according to claim 1.

13. The orthopaedic bedspring according to claim 12, wherein said slats (2) have limited flexibility.

* * * * *